US006372043B2

(12) United States Patent
Tracy et al.

(10) Patent No.: US 6,372,043 B2
(45) **Date of Patent: *Apr. 16, 2002**

(54) APPARATUS AND METHOD FOR APPLICATION OF LUBRICANTS TO THE SURFACE OF METALLIC SHEET MATERIAL

(75) Inventors: Daniel L. Tracy, McKeesrocks, PA (US); W. J. Alexander Hugill, Clearwater, FL (US); Robert E. DeBlois, Lakewood, CO (US)

(73) Assignee: Coral Chemical Co., Waukegan, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,313

(22) Filed: Oct. 28, 1998

(51) Int. Cl.[7] ..... B05C 1/04

(52) U.S. Cl. ..... 118/264; 118/268; 118/260; 118/261

(58) Field of Search ..... 118/224, 236, 118/249, 260, 261, 264–268; 427/429; 156/441.5; 184/64, 65, 101, 102

(56) References Cited

U.S. PATENT DOCUMENTS

| | | | | |
|---|---|---|---|---|
| 4,601,918 A | | 7/1986 | Zaman et al. | 118/234 |
| 4,604,300 A | | 8/1986 | Keys et al. | 118/266 |
| 4,712,507 A | | 12/1987 | Helling | 118/264 |
| 4,962,721 A | * | 10/1990 | Peek | 118/264 |
| 4,995,934 A | | 2/1991 | Janatka | 118/264 |
| 5,549,752 A | | 8/1996 | Hahn et al. | 118/234 |
| 5,690,739 A | * | 11/1997 | Sassa et al. | 118/268 |
| 5,985,028 A | | 11/1999 | Cornell et al. | 118/264 |
| 6,013,312 A | | 1/2000 | Cornell et al. | 427/210 |

* cited by examiner

*Primary Examiner*—Laura Edwards
(74) *Attorney, Agent, or Firm*—Fitch, Even, Tabin & Flannery

(57) ABSTRACT

The invention provides an apparatus and method for applying a liquid lubricant to at least one surface of a moving metal sheet. The apparatus includes a wick and a liquid lubricant reservoir and at least one conduit in flow communication with the wick and reservoir. The liquid lubricant moves from the reservoir in controlled amounts, through the conduit or conduits to the wick by gravity flow and is moved by capillary action through the wick to the surface of the moving metal sheet without the application of an external mechanical force, such as a piston, to generate a pressure gradient through the wick to move the liquid lubricant therethrough.

23 Claims, 4 Drawing Sheets

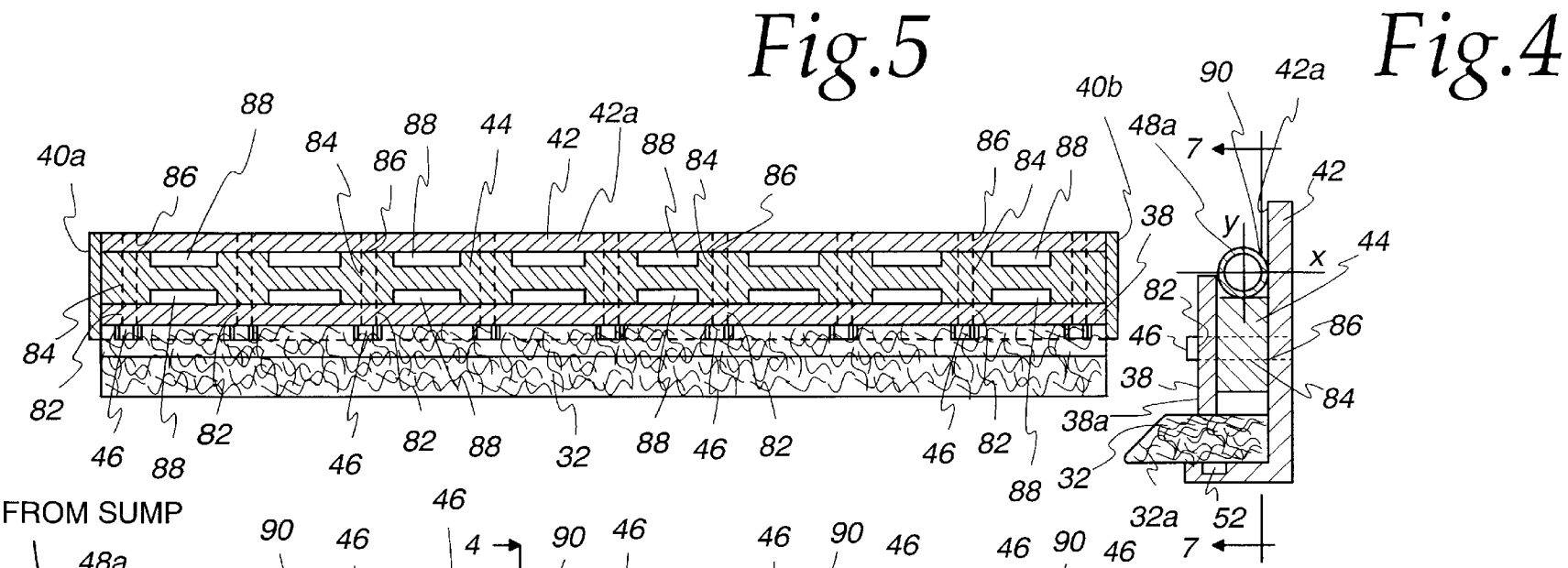
Fig.4
Fig.5
42a
42
44
86
84
x
y
90
7
48a
40b
38
82
46
38a
32
52
88
40a
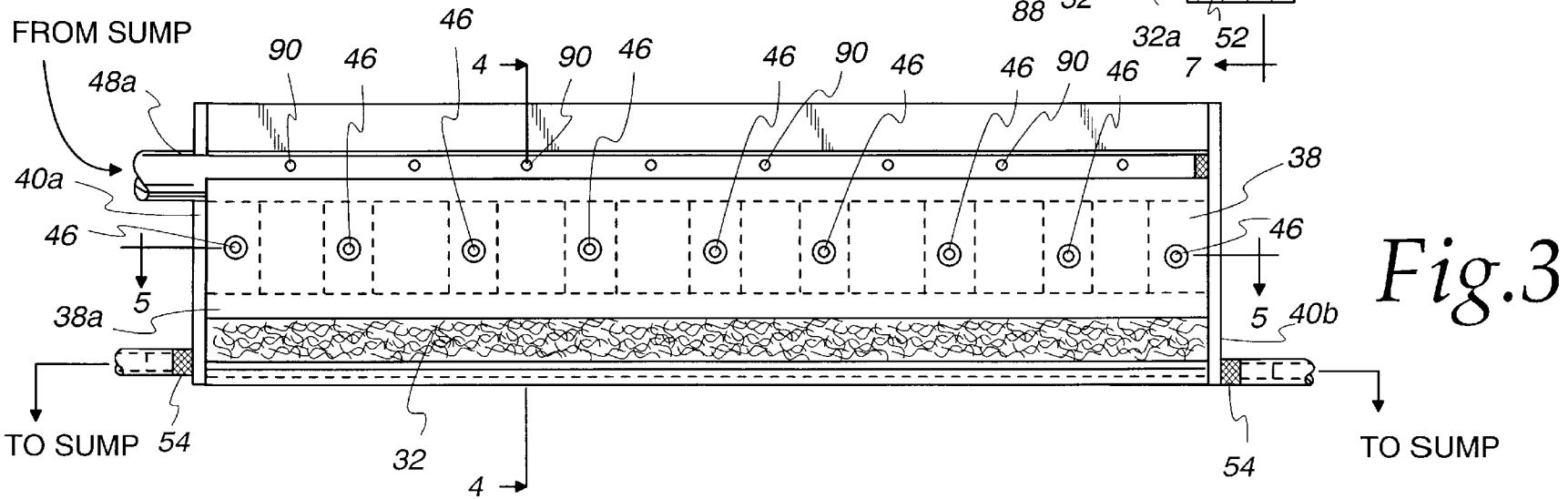
Fig.3
TO SUMP
38
46
5
40b
54
90
32a
48a
FROM SUMP
40a
38a
4
32

APPARATUS AND METHOD FOR APPLICATION OF LUBRICANTS TO THE SURFACE OF METALLIC SHEET MATERIAL

FIELD OF THE INVENTION

The invention generally relates to devices and methods for applying a lubricating coating to one or more surfaces of metallic sheet materials such as, for example, tin-plated steel stock, and aluminum sheet stock used to make aluminum beverage cans.

BACKGROUND OF THE INVENTION

Metallic sheet materials are used in the fabrication of a wide variety of articles of manufacture including beverage cans, metal housings, metal panels, metal tools, structural metal components, etc. Such metallic sheet materials are pressed, forged, stamped, drawn, ironed or otherwise formed using pressure applied in various ways to shape the metal sheet materials into useful products. In many such forming processes, it is essential that one or more surfaces of the metallic sheet materials are coated with one or more lubricant compositions of petroleum and vegetable oils, petroleum distillates, esters, fatty acids and other components that provide lubricating properties to metallic sheet surfaces.

In many manufacturing processes, the lubricant coatings are applied to the sheet surfaces as the sheet material moves through the forming process. The lubricants perform functions including the primary function of reducing the coefficient of friction between the metallic sheet surfaces and the surfaces of handling equipment press components, forming dies and other related forming equipment. Thus, the proper application of lubricant coatings to the moving sheet surfaces is essential to such manufacturing processes and prevents substantial product defects, waste of materials, product failures, excessive forming and handling equipment wear, excess maintenance costs and other undesired adverse effects.

For example, such lubricant coatings are used in the process for forming tin-plated steel stock into various articles of manufacture, and for forming aluminum sheet stock into beverage can bodies. In forming aluminum stock into beverage can bodies, a continuous strip of aluminum sheet stock is fed from a supply coil to a "cupping press." In that press, metal dies punch disks of aluminum from the sheet stock and press the disks into shallow cup-shaped blanks. The "cups" are transferred to a "body maker" where they are drawn and ironed into the shape of an elongated can body. The can body typically is trimmed and then cleaned, coated, printed and often subject to one or more additional shaping steps before it is filled with a beverage and sealed.

In the "cup" forming step, substantial frictional engagement occurs between the surfaces of the aluminum sheet stock and portions of the cupping press contacting the sheet stock surfaces, including the forming dies, stripping plates and other press surfaces. Consequently, one or more lubricating coatings are applied to the exposed upper and lower surfaces of the moving aluminum sheet stock while it is fed into the cupping press. The lubricating coating reduces the coefficient of friction at the interface surfaces of the aluminum sheet and the cupping press, and particularly the surfaces of the forming dies, to facilitate the proper pressing of the aluminum "cups" . The lubricant coating also assists in proper passage of the sheet material into the press and waste materials out of the press. Those waste materials include the remaining web of aluminum sheet after the "cups" are punched from the aluminum sheet stock.

The inconsistent, inadequate, and non-uniform application of the lubricant coating to the moving aluminum sheet stock surfaces (as well as the surfaces of tin-plated steel and other metallic sheet materials) can result in under-lubrication of portions of the metallic sheet surfaces and, in some instances, over-lubrication of other portions of the sheet surfaces. As a result, excessive frictional forces may develop on the under-lubricated portions of the sheet surfaces at various stages of the forming process that interfere with or even prevent proper operation of the forming process. Inadequate lubrication of the sheet surfaces also may result in excessive defects in portions of the formed product, damage and excessive wear to the presses and forming dies, loss of materials and production time due to improperly formed products, increased press down time, sheet or product jams, increased costs of material and labor, and similar undesirable interruptions and inefficiencies in the manufacturing process.

For example, if an inadequate amount of lubricant coating is applied to the aluminum sheet metal used to make can bodies, then the aluminum "cups" may not properly form during the cupping stage. The "cups" may have holes or gaps in their sides or bottom, they may acquire undesirable draw marks or scratches on their sides and bottoms, they may have inconsistent dimensions or other such defects rendering them unacceptable for further processing. If such difficulties with the lubricant coatings persist, the defects rates, materials waste, and cost inefficiencies can quickly reach commercially unacceptable levels.

Similarly, the application of excessive amounts of lubricant to the sheet material surfaces also is undesirable. Over lubrication of part or all of the sheet material surfaces may result in inadequate forming pressures, sticking between press and sheet material surfaces, feed jams, improper forming, product ejection jams, jams in waste material ejection systems and other similar adverse effects. The use of excessive amounts of lubricants also may result in unwanted build up of lubricants on the forming and handling equipment requiring increased cleaning and maintenance cost and excessive lubricant expenses.

Thus, in most, if not all, applications it is desirable to apply such lubricant compositions to the sheet material surfaces in a generally uniform layer to ensure that the sheet surfaces are provided with a sufficient, but not excessive, amount of the lubricant composition. The amount of the lubricant composition and its distribution may vary from one manufacturing process to another depending on the composition of the metallic sheet materials, the surface properties and characteristics of the materials, the surface area exposed for contact with the handling and forming equipment, the size and shape of the formed product, and the forming conditions (pressures, temperatures, speeds, etc.), among other considerations that affect the necessary amount and distribution of the lubricant coating. In some applications, those amounts and distribution may be calculated, in others they are determined by field testing and analysis.

The careful control of the amount and application rate of a lubricant coating also provides substantial opportunities to optimize the necessary amount of lubricant applied and the distribution of the lubricant to enhance the operation of the forming and handling process and to minimize manufacturing expenses. Such improved controls and application methods also permit the consideration of improved forming processes, increased production speeds, alternative sheet material compositions, improved production schedules and desirable cost containment approaches.

Such improved controls are a concern in many forming processes, including aluminum can body forming processes where the sheet material feed rates are inconsistent and vary over short periods of time from relatively slow rates to relatively fast rates. Such improved controls are of particular concern where it is desirable to reduce or minimize the amount of lubricant applied to the metallic sheet surfaces. In that instance, even small variations in the lubricant coating as one approaches the minimum required lubricant amount may result in significant production difficulties due to the potential for inadequate lubrication of portions or all of the sheet material surfaces. The need for improved control over the application of the lubricant coating is further necessary where increased sheet feed rates are desired.

In prior conventional systems, a variety of approaches were used to apply and distribute the necessary lubricant coatings to sheet material surfaces. For example, in one system, a continuous length of metallic sheet material was immersed and advanced through a lubricant composition bath. A squeegee, blade or roller system then was used to remove the excess lubricating composition from the sheet surfaces and reduce the coating to the desired amount, thickness and distribution.

In those and other conventional systems, it often was difficult to maintain a consistent and uniform lubricant coating, particularly when using "neat" lubricant compositions comprised primarily of active lubricating components. In addition, it often was difficult to operate such conventional systems cost effectively at relatively high sheet feed rates, and at highly variable sheet feed rates, to avoid excessive waste of the lubricant composition and to reduce significant cost inefficiencies.

The active component of the lubricant compositions typically used in the production of aluminum beverage cans are petroleum oils, vegetable oils, esters, fatty acids, emulsifiers, surfactants and combinations thereof. The amount of the active lubricant component applied to aluminum sheet stock prior to the cupping operation typically can range from approximately 100 mg/$M^2$ to approximately 400 mg/$M^2$, which is equivalent to approximately about 10 to 45 mg/$ft^2$, or about 6 to about 10 mg/gm of "cup" (where approximately 4 to 5 "cups" are formed per square foot of sheet stock).

Conventional lubricating systems often cannot effectively provide coatings formed from such lubricant compositions in their "neat" form, particularly at the lower desired application amounts for many of the above-mentioned reasons. Moreover, attempts to reduce and optimize the amount of "neat" lubricant used to form the required coating have not overcome undesirable fluctuations in the amount, distribution and thickness of the coatings applied by such conventional systems in a commercially acceptable fashion.

As a consequence, one approach to address those difficulties was to modify the lubricant composition rather than the application system. For example, in many conventional systems, the active lubricant components are emulsified with water to form an aqueous lubricating composition. The composition of such lubricant emulsions typically include approximately from 40% to 75% water and approximately 25% to 60% active lubricants and emulsifiers. By using such aqueous emulsions, one could coat the sheet material with a desired amount of active lubricant by applying the emulsion in sufficiently large, more controllable volumes. As a result, the use of emulsified lubricant compositions permitted improved application of reduced amounts of active lubricant composition to the sheet surfaces, along with significant amounts of water.

However, the use of aqueous emulsions in such systems created other undesirable effects that impacted both the effective operation and the cost efficiency of metallic sheet forming processes, including those used to form the aluminum "cups" for beverage can bodies. The presence of relatively large volumes of water in the prior lubricant emulsions often caused corrosion and increased wear on the metallic surfaces of the presses and forming dies. Aqueous lubricant emulsions, in addition, typically tended to leach important metallic components from the metal surfaces of the forming presses and forming die surfaces, such as cobalts and nickels, which are in regular contact with the aqueous lubricant emulsion. That corrosion, leaching and the resulting increased wear on the press and die surfaces impaired the proper operation of the presses over extended periods of time and reduced the expected useful life for the press components.

In addition, in many processes, the use of large amounts of aqueous emulsions required significant recycling systems to allow the conservation and reuse of excess lubricant emulsions. Such recycling systems increased the overall system expenses and maintenance requirements, and further require additional filters, pumps, and preservatives and other precautions to limit the risk of contamination and deleterious impurities in the emulsion.

For example, aqueous emulsions used in "cupping" operations for forming aluminum can bodies frequently caused significant leaching of metals from the cupping dies, and corrosion, pitting and other damage to the cupping dies, strippers and other exposed surfaces of the press. The premature replacement of that equipment and tooling often resulted in the need for considerable additional investments which could be avoided through use of alternative "neat" lubricant compositions. In addition, in those systems, it is necessary to add filters to remove fines of aluminum, dirt, grits etc. from aqueous lubricant and to use emulsions, algicides and bactericides to limit the growth of microorganisms in the emulsion.

Another attempt to address the cost efficient and consistent application of liquid lubricating compositions to aluminum beverage can sheet stock is disclosed in Hahn et al., U.S. Pat. No. 5,549,752, issued on Aug. 27, 1996 to Coors Brewing Co. In that apparatus, a multi-part, reciprocating piston system was used to dispense "cupping" lubricant through bores to a wick. The aluminum sheet surfaces were contacted by a wick or by a transfer roller which was in contact with the wick to apply a lubricating composition to aluminum sheet surfaces. In such systems, it was possible to use "neat" lubricants.

Piston controlled systems such as those disclosed in the Hahn et al. patent are relatively complex to operate and maintain which results in undesirable operational problems and increased upkeep expenses. They also often require complex electronic or other controls to avoid undesirable fluctuations in the application of lubricant compositions to the sheet surfaces, particularly when there are stock sheet feed fluctuations and temporary line shut downs. The demands on the pumps in such systems also reduced pump life further increasing the system's operational expenses.

Systems such as that disclosed in Hahn et al., in addition, often cannot reliably and consistently maintain the required flow of active "neat" lubricant compositions to sheet surfaces to form the desired lubricant coatings at relatively high sheet feed rates, such as those used to maintain a "cupping" press speeds of about 120 strokes per minute and greater. As a result, those systems often cannot provide the minimum amounts of lubricant required for forming aluminum "cups" or other types of pressed metal objects. This limitation can be a significant impediment in aluminum can body plants which often run at an approximate average rate of about 180 "cupping" press strokes per minute, and as fast as about 200–225 press strokes per minute.

The lubrication system of the invention provides an improved apparatus and method for applying one or more lubricating compositions to the surfaces of metallic sheet materials. It provides an effective, flexible and costs effective approach to forming such coating that may be used to dispense relatively small amounts of such lubricants, including "neat" lubricant compositions. As a result, it avoids many of the problems of the prior systems and allows significant potential cost reductions in both equipment and the use of lubricant compositions.

SUMMARY OF THE INVENTION

The invention provides an apparatus and method for applying a liquid lubricant to at least one surface of a moving metal sheet. The apparatus includes a wick and a liquid lubricant reservoir and at least one conduit in flow communication with the wick and reservoir. The liquid lubricant moves from the reservoir in controlled amounts, through the conduit or conduits to the wick by gravity flow and is moved by capillary action through the wick to the surface of the moving metal sheet without the application of an external mechanical force, such as a piston, to generate a pressure gradient through the wick to move the liquid lubricant therethrough.

The reliance upon a wicking or capillary flow for transmitting the liquid lubricant through the wick without the necessity of the application of an external mechanical force to generate a pressure gradient through the wick is extremely beneficial to simplify the apparatus applying lubricant to the metal sheet. It has been found that the capillary action by which the liquid lubricant flows through the solid but porous wick because of the relative attraction of the liquid lubricant molecules of the lubricant with the solid wick is sufficient for applying precise amount of thin lubricant coating on metal surfaces traveling at very high speeds. This simplification not only reduces the cost of the apparatus, but also lowers the risk of down time and reduces the maintenance expenses which result from more complicated and difficult to maintain mechanical lubricant application systems.

Moreover, the apparatus and method of the invention surprisingly provide an effective, sufficiently uniform lubricant coating for the purposes of press forming, drawing and ironing or other shaping of the metal sheet material. The capillary flow of liquid lubricant, which is not in the form of an emulsion, to the moving metal sheet permits a level of control of coating thickness and lubricant weight and distribution, even at relatively low coating weights, under a wide range of sheet feed rates, sheet feed rates that are highly variable during production runs, and conditions not available using conventional systems.

As a result, the invention permits the application of thin lubricant coating in manufacturing processes, such as those used to produce "cups" for aluminum can bodies, without the need for aqueous lubricant emulsions or other lubricant compositions that may cause corrosion or increased wear to forming equipment, additional additives or treatment systems, or additional systems required for the preparation and dispensing of lubricant emulsions. Because the invention does not require complicated controls to generate a pressure on the lubricant to force it into and through the wick, such as a pump, piston or other similar mechanical control system, it is easily maintained and relatively inexpensive to produce. These benefits render the apparatus and method of the invention significantly more cost effective and desirable for many different applications.

In one aspect, the wick is immediately adjacent to and in contact with the moving metal sheet for application of the lubricant. In an important aspect, the reservoir is located relative to a plurality of conduits between the reservoir and wick and is located relative the wick, such that the lubricant moves by gravity from the reservoir to and through the conduits to the wick. In one aspect, the reservoir includes ports which control flow of lubricant from the reservoir to the wick, and also may control the reservoir level and amount. The conduits also may include one or more surfaces positioned to direct and spread the lubricant flow between the reservoir and wick to evenly distribute lubricant to the wick material and to avoid under supply or substantial drying of portions of the wick material.

In another important aspect the wick is immediately adjacent to and in contacting engagement with a lubricant application/transfer roller which is in rolling contact with the moving metal sheet to transfer the liquid lubricant from the wick to the moving sheet. The use of the application/transfer roller in combination with the wick which moves the liquid lubricant by capillary action and the above-mentioned controlled flow of lubricant from the reservoir is particularly effective for metering and applying precise amounts of lubricant to form a relatively thin lubricant layer on the moving sheet. Moreover, with the slowing of the metal sheet or even to the extent of stopping the sheet or equipment, the roller in contact with the wick will stop the flow of lubricant and will not cause an over abundance of lubricant on the surface of the application/transfer roller or sheet once the sheet or equipment increase speed of movement.

In another important aspect, the wick is a fibrous, felt material with properties which are effective for moving the lubricant by capillary action through the wick to another surface in contact with the wick such that at least about 130 $mg/M^2$ of lubricant is applied to a metal sheet moving at speeds of from about 5 inches (12.7 cm) to about 90 ft. (27.4 m) per minute. The composition, density, thickness of the wick affect the capillary flow of lubricant through the wick. Each of these properties are selected to be effective for providing a metered, capillary flow of the liquid lubricant to the surface in contact with the wick to receive a coating of lubricant.

In an important aspect, the wick is made of a matrix of fibrous elements including polyester fibers, such as Dacron or a blend of polyester fibers and wool fibers with density of from about 0.072 $oz/in^3$ to about 0.175 $oz/in^3$. In one aspect of the wicking materials, the wick has a thickness of about 0.375 inches (9.5 mm) and a weight in the range of from about 35 $oz/yd^2$ to about 85 $oz/yd^2$. In another aspect, the wicking material has a thickness of about 0.75 inches (19.0 mm) and a weight of about 112 $oz/yd^2$ which, on a unit weight basis, is similar to a wicking with a thickness of 0.375 inches (9.5 mm) and a weight of 56 $oz/yd^2$. These wicking materials are used with liquid lubricants for forming aluminum "cups" for beverage can bodies with viscosities in the range of about 40 to about 800 SSU, and preferably in the range of about 100 to about 250 SSU at about 100° F. (37.8° C.).

The rate at which the lubricant is applied is a function of the lubricant's capillary flow properties under the expected operating conditions and the capillary flow provided by the wick material for the lubricant. Using the wicks with the properties described above, flow rates between the reservoir to the wick of from about 0.30 to about 2.0 ml per running foot for aluminum sheet stock about 60 in. (152 cm) wide will provide the desired amount of lubricant in an aluminum cupping process in the manufacture of drawn aluminum cans. The lubricant used in the invention is not in the form of typical aqueous emulsions which often will separate while flowing through the wick material, (e.g., in the invention, typical aluminum can cupping lubricants should not have more than about 10 weight percent water). In one important aspect, the invention permits the application of a lubricant coating of an approximately 100% active or "neat" lubricant coating on the surface of aluminum sheet stock moving at the above described speeds averaging from about 5 in. (12.7 cm) to about 90 ft. (27.4 m) per minute at lubricant weights as low as 130–140 mg/$M^2$ and 20–28 mg/cup (where approximately 4 to 5 cups are formed per square foot of sheet stock), and about 2 to about 3 mg/gm of "cup," using lubricant compositions with viscosities of from about 100 to about 450 Saybolt Seconds Universal (SSU) at 100° F. (37.8° C.), as noted above.

BRIEF DESCRIPTION OF THE DRAWINGS

For a more complete understand of the invention, reference should be made to the drawings wherein:

FIG. 3 is a front elevational view of the applicator system of the invention, including the flow element matrix.

FIG. 4 is a sectional view of the applicator system of FIG. 3 along the line 4—4.

FIG. 5 is a sectional view of the applicator system shown in FIG. 3 along the line 5—5.

It should be understood that the above figures are not necessarily to scale. In certain instances, details of the actual structure which are not necessary for the understanding of the present invention have been omitted. It should also be understood that the invention is not necessarily limited to the particular embodiments discussed herein.

DETAILED DESCRIPTION OF THE INVENTION

Figure 1:
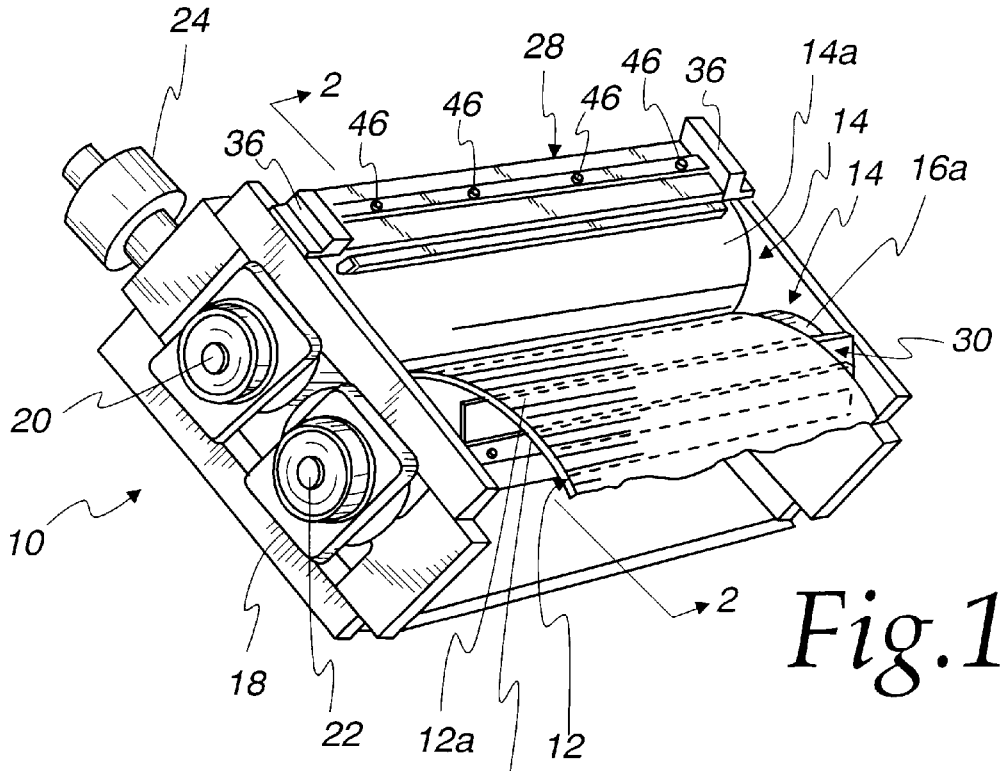
FIG. 1 is a side perspective view of one preferred embodiment of the coating station of the invention with a portion of metallic sheet material advanced therethrough.
Figure 2:
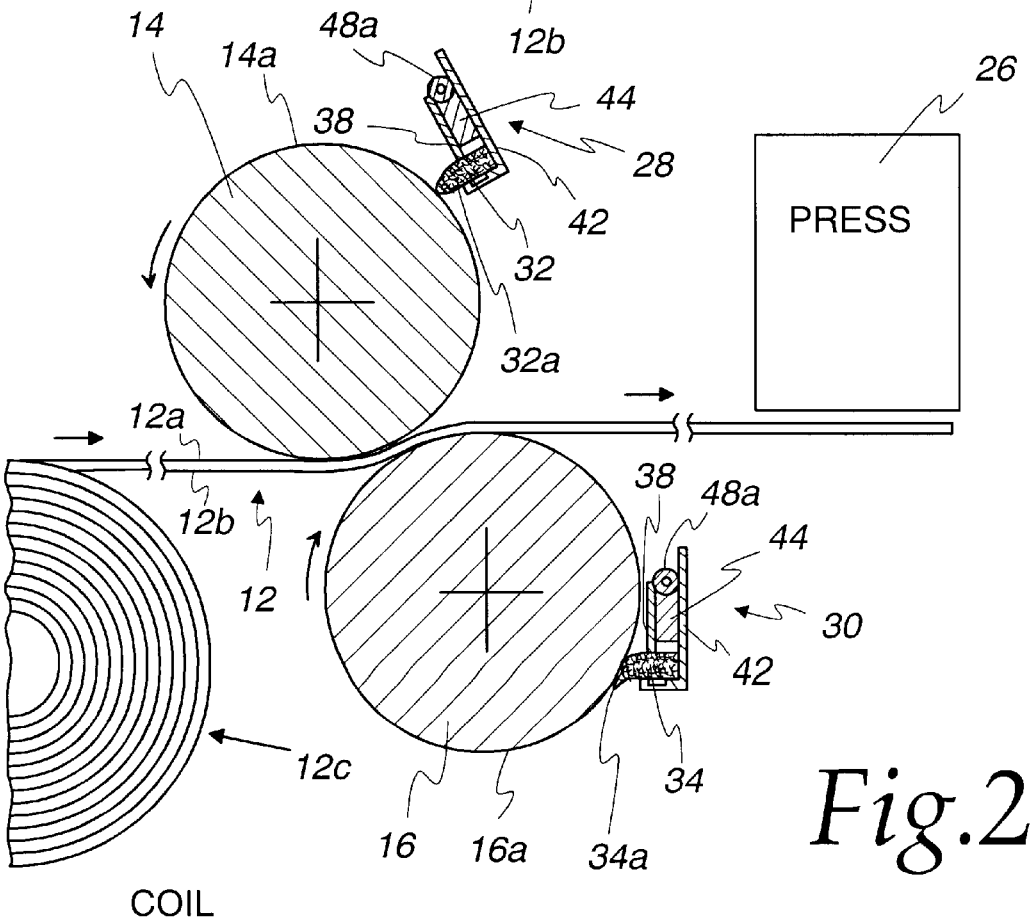
FIG. 2 is a partial sectional view of the coating station shown in FIG. 1, along line 2—2, with certain components omitted for ease of reference.

One embodiment of the invention is shown in FIGS. 1 and 2 which illustrate a coating station 10 with a strip of metallic sheet material 12, having an upper surface 12*a* and lower surface 12*b*. The metallic sheet material 12 is shown advancing through the coating station 10 from a coil or roll of the sheet material 12*c*. The sheet material 12 often is advanced through the lubricating station 10 by powered rollers (not shown) that rotationally engage the exposed sheet surfaces 12*a* and 12*b* to draw the sheet material 12 from the coil 12*c*.

The sheet material 12 may be of a variety of materials such as aluminum metal stock used to manufacture beverage can bodies, tin-plated steel sheeting materials, alloys of various metals, steel sheeting or other such metallic sheet materials. The metallic sheet material 12 typically is predimensioned to a desired thickness, width and length. In aluminum can manufacturing processes, the aluminum sheeting material may range from approximately 0.0095 to 0.0194 inches (0.24 to 0.492 mm) in thickness. For certain beverage can products, the aluminum stock typically is about 0.0104 inches (0.264 mm) thick. Such aluminum sheet stock is typically about 29–70 inches (73–178 cm) wide, and most often is about 60 inches (152 cm) depending on the size and number of aluminum "cups" formed by each cycle of the "cupping" press, which is the first forming step in producing aluminum can bodies. In many aluminum can forming processes, approximately 4 to 5 "cups" are formed per square foot stock that is about 60 inch (152 cm) wide and about 0.0104 inch (0.264 mm) thick. The aluminum stock used in such application may be of various lengths depending on the size of the aluminum sheet coil 12*c*.

The lubricating composition used to form the necessary coating or film on the surface or surfaces of the sheet material 12 is selected after consideration of a number of factors affecting the process for forming and shaping the sheet material, the final formed product and the lubricant cost. These factors include, among others, the forming properties and type of metallic sheet material 12, the thickness of the sheet material 12, the type of forming process, the pressures developed in the forming process, the forming speed, the forming temperatures, the shape and dimensions of the final desired product, the nature of the forming dies, and the presence of any other coatings or surface treatments on the sheet material 12.

In one aspect, the system applies conventional "neat" lubricants for aluminum sheet stock such as those including from about 50% to about 70% by weight petroleum oils, from about 10% to about 30% by weight vegetable oils, and from about 10% to about 15% by weight other components such as fatty acids, esters, napthenic distillates, surfactants, emulsifiers and corrosion inhibitors. In another aspect, the system may apply lubricants with ester contents from about 30% to about 70% by weight of the lubricant composition. In yet another aspect, the system may apply "neat" lubricants conventionally used for tin-plated steel sheet materials.

In many instances, the amount and thickness of the lubricant coating applied to a sheet surface is stated in terms of the mass of lubricant per unit area of the sheet material, i.e., ounces per square foot of sheet stock, or grams per square meter, or, alternatively, as the mass of lubricant per unit mass of the sheet material. For example, in forming aluminum can bodies, the desired amount of lubricant often is expressed in terms of the milligrams of lubricant per square foot of aluminum sheet, the milligrams of lubricant per "cup" or the milligrams of lubricant per gram of aluminum. The amount of lubricant applied on an aluminum "cup" is typically measured by determining the mass of a formed "cup" after it is ejected from the "cupping" press, while it still retains its lubricant coating, and subtracting the mass of the cleaned "cup," i.e., without the lubricant coating.

As shown in FIGS. 1 and 2, a desired amount of lubricant composition is applied to the sheet surface by at least one coating station 10 which typically includes an upper transfer roller 14 and a lower transfer roller 16 mounted on a frame 18. Each of the rollers 14 and 16 are supported by an axle and bearing assembly 20 and 22, respectively allowing their rotational movement and, in some instances, may be provided with a powered drive train so that the rollers 14 and 16 also act to advance the sheet stock through the system.

In the one embodiment, the upper roller 14 acts as a "pinch" or "nip" roller that is movable relative to the lower roller 16, which is typically fixed. The upper roller 14, and lower roller 16 further are positioned to engage the surfaces of 12*a* and 12*b* respectively, of the sheet material 12 at a preselected "nip" or "pinch" pressure as it is advanced through the coating station 10.

The desired "nip" or "pinch" pressure typically is determined from the properties of the sheet material 12, the lubricant composition, and the desired coating thickness and distribution. The nip pressure also may be adjusted to assist in maintaining the sheet material 12 properly aligned in the lubricating station 10. In the one aspect used to lubricate aluminum sheet stock for can bodies, the "nip" pressure is from about 20 to 100 psi. As a result, this upper roller surface 14*a* and the lower roller surface 16*a* deposit lubricant on the upper 12*a* and lower 12*b* sheet material surfaces respectively in a reproducible, approximately even and properly distributed layer.

The rollers 14 and 16 further are provided with a resilient covering 14*a* and 16*a*, respectively of synthetic or natural rubbers or other natural or synthetic materials providing an outer surface suitable for carrying and transferring lubricating compositions to the sheet surfaces. In the one embodiment, the resilient surface is made of relatively smooth polyurethanes, neoprene, synthetic rubbers with a durometer from about 45 to about 90, which provide outer surfaces 14*a* and 16*a* capable of receiving the lubricating composition from the applicators 28 and 30 and properly applying the lubricant to the sheet material surface 12*a* and 12*b*. In some applications, steel or iron surfaced rollers also may be used. The specific composition, thickness, texture and properties of the roller resilient surfaces 14*a* and 16*a* will depend on the nature of sheet material, the construction of the forming system as a whole, the range of system operating speeds, and the compatibility of the lubricant composition with the resilient covering.

In an alternative embodiment, a series of multiple transfer rollers (not shown) may be used to transfer the lubricant composition from the applicators 28 and 30 to the sheet surfaces 12*a* and 12*b*. Similarly, in some applications, it may be desirable to use rollers with different resilient surface compositions and properties, as well as non-resilient surfaces. In addition, in some systems the transfer rollers are powered and also act as drive rollers to advance the sheet material.

In the embodiment shown in the figures, the frame 18 also supports an upper lubricant applicator 28 provided with an upper flow element matrix 32 such as a wick material and a lower lubricant applicator 30, provided with a lower flow element matrix 34 such as the same or a different wick material. The lubricant applicators 28 and 30 are preferably removably attached to the frame 18 with mounting brackets or the like, so that, if necessary, they may be removed from the frame for maintenance, repair and adjustments.

Figure 6:
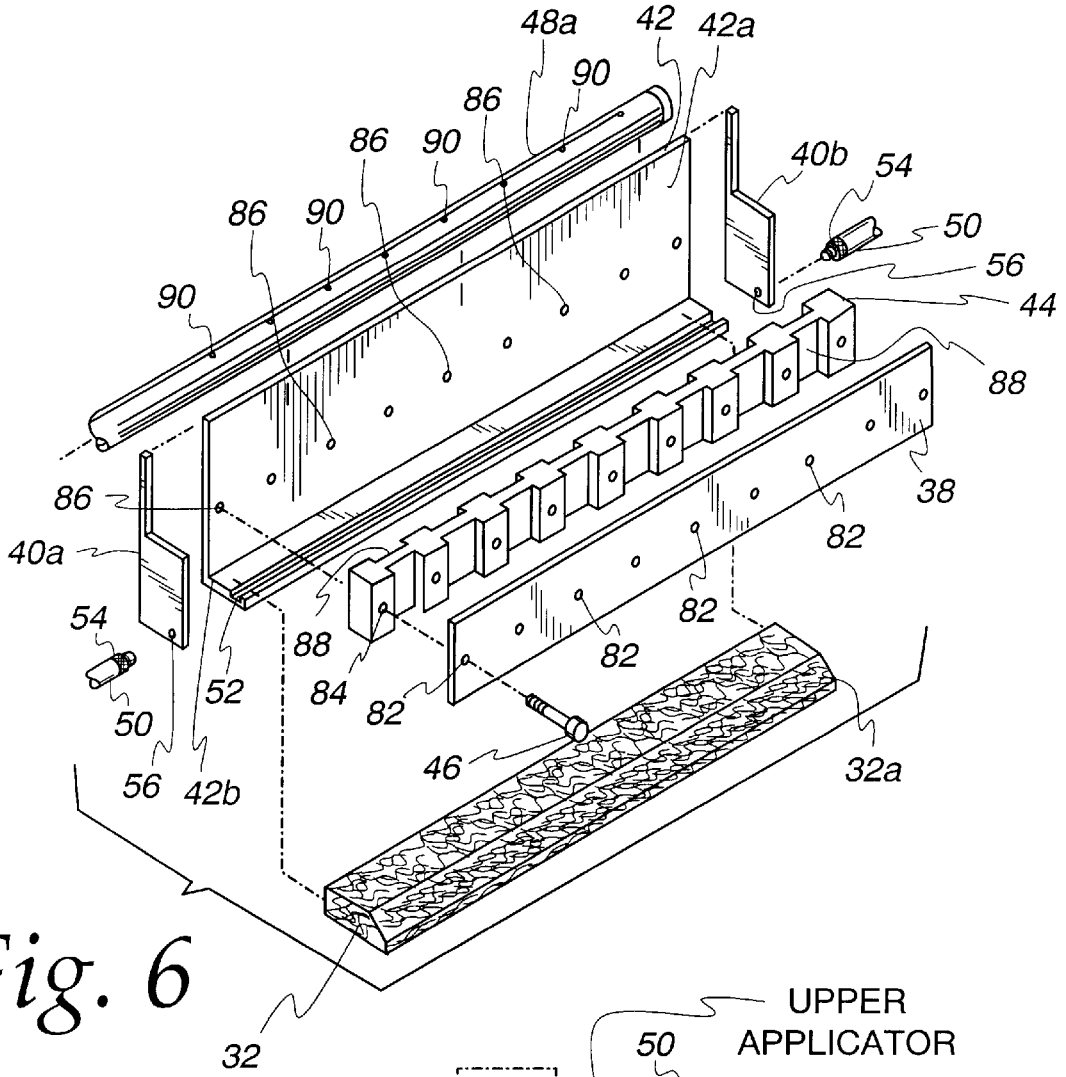
FIG. 6 is an exploded, perspective view of the applicator system shown in FIG. 3 illustrating certain of the components of the system.
Figure 7:
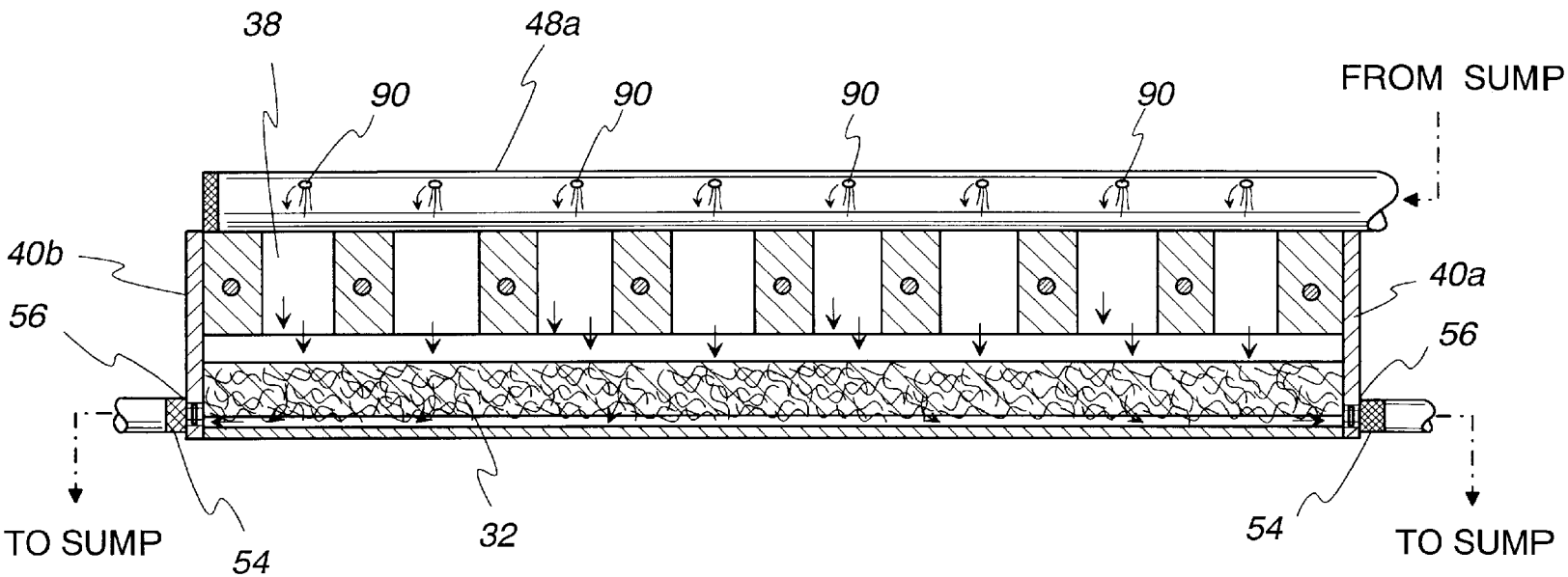
FIG. 7 is a sectional view of the applicator system shown in FIG. 4 along the line 7—7.

As shown in the figures, and particularly in FIGS. 5–7, each applicator 28 and 30 further includes a front plate 38, side walls 40 and a rear plate 42. The applicators 28 and 30 also include a structural core element 44 disposed between the front plate 38 and rear plate 42, secured with plate mounting bolts 46. Lubricant supply conduits 48 extend to the applicators 28 and 30 forming a lubricant reservoirs 48*a* within the applicators 28 and 30. Lubricant return conduits 50 are removably fixed to one or both the side walls 46 of the applicators 28 and 30.

In one aspect of the system, the flow element matrices 32 and 34 are wicks made from one or more wicking materials of a matrix of felted or non-woven fibrous materials, such as a matrix of polymeric or other synthetic fibers or filaments (including polyesters, polypropylene and similar fibers), wool fibers, plant fibers, metal filaments and combinations of such materials. The flow element matrices or wicks 32 and 34 may comprise a single thickness of such materials or multiple plies or layers of the separate matrices, depending on the desired flow properties, flow rates, cost, efficiency concerns and other factors that may affect the flow properties of the flow elements matrices 32 and 34 as discussed herein.

The flow element matrices 32 and 34 will be referred to as wicks herein, but may include other matrices that are not typically considered as "wicks." For example, one or more alternative materials suitable for flowing lubricants to the surfaces of rollers or metallic sheet materials also may be used in or as part of the wicks 32 and 34. For example, depending on the application, woven fibrous fabrics or composites, porous polymeric matrices, metallic or non-metallic filaments disposed in a suitable arrangement or matrix, etc. may be used in wicks 32 and 34 after a proper determination of their suitability in such applications as described herein.

The wicks 32 and 34 typically are selected based on their compatibility with the intended lubricant composition, their density and their porosity as determined by the flow of lubricant through the wicks 32 and 34. The internal construction, (i.e., single or multiple plies, homogenous or non-homogenous compositions, etc.) of the wicks 32 and 34 also may be preselected to provide a desired flow or percolation rate, or range of flow or percolation rates, for a particular lubricant composition and manufacturing process. Other considerations include the desired amount (or range of amounts) of the lubricant composition which is to be applied to the metallic sheet surface to form the desired lubricant coating, the approximate feed rates of the sheet material 12, the lubricant's flow properties, the surface characteristics of the sheet material, and related considerations.

In view of those considerations, the wicks 32 and 34 are selected to provide a sufficient flow of active lubricant composition to the metallic sheet surfaces 12*a* and 12*b* to provide the desired weight or thickness of the lubricant coating. That flow rate may be based on the lubricants' capillary flow through the flow element matrices by capillary action, as well as a gravity feed of lubricant to the wicks 32 and 34.

The lubricant properties that affect the capillary flow or percolation properties and rates through the wicks 32 and 34 include viscosity, application temperature, chemical composition, reactivity with the wick materials and other related considerations. The flow rate through the wicks also may be affected by the lubricant characteristics in relation to the transfer rollers 14 and 16, when such rollers are used.

The lubricant holding capacity of the wicks 32 and 34 is an additional consideration in selecting those materials. While it is not required, in one aspect, a sufficient amount of lubricant is retained within the wicks 32 and 34 to saturate the wicks 32 and 34 to assist in providing a consistent, uniform supply of lubricant to the transfer roller surfaces 14*a* and 16*a*, and thus the exposed surfaces 12*a* and 12*b* of the metallic sheet material. When saturated, the wicks 32 and 34 provide additional temporary reservoirs of the lubricant composition to minimize the effect of temporary inconsistences in the lubricant supply and to assist in providing rapid response to variable stock feed rates and to provide start up of the system after interruptions or shut downs of the system.

The wicks' wear properties, flexibility and conformability with the rollers 14 and 16, (or other lubricant receiving surfaces) are further considerations in selecting the materials making up the wicks 32 and 34. The wicks 32 and 34 typically are in continuous contact with such lubricant receiving surfaces, and are therefore subject to significant wear and abrasion conditions. Therefore, the materials used to fabricate the wicks 32 and 34 should be sufficiently flexible to permit the positive biasing of the wicks 32 and 34 into engagement with the lubricant receiving surfaces, and those materials should be resistant to friction and wear under the system operating conditions.

In one aspect of the invention, the wicks 32 and 34 are made from felted wick material of Dacron polyester fibers (or other similar polyester fibers) and have a thickness of about 0.375 inches (9.5 mm) to about 0.75 inches (19.0 mm). In that aspect, the wick density is from about 0.072 oz/in$^3$ to about 0.175 oz/in$^3$. In another aspect, wicks may have a thickness of 0.375 inches (9.5 mm) and a weight from about 35 oz/yd$^2$ to about 85 oz/yd$^2$. In yet another aspect, the wicks 32 and 34 have a thickness of about 0.75 inches (19.0 mm) and a weight of about 112 oz/yd$^2$. Such wicks are selected for use with the above-mentioned "neat" liquid lubricants for forming aluminum "cups" with viscosities from about 40 to about 800 SSU at 100° F. (37.8° C.).

In still another aspect, the wicks 32 and 34 are made from felted Dacron polyester fibers (or other similar polyester fibers) with a weight of about 35 oz/yd$^2$ for wicks with a thickness of about 0.375 inches (9.5 mm) and a porosity of 360 seconds. Such wicks are selected for use with "neat" liquid lubricants for forming aluminum cups, such as those mentioned above, with viscosities from 65–800 SSU at 100° F. (37.8° C.). In yet another aspect, the wicks 32 and 34 are made of felted. Dacron polyester fibers (or other similar polyester fibers) and have a thickness of 0.75 inches (19.0 mm) and a weight of about 112 oz/yd$^2$ for use with such "neat" liquid lubricants having viscosities from 110 to 800 SSU at 100° F. (37.8° C.).

The components of the upper applicator are shown in greater detail in FIGS. 3–7. In the preferred embodiment, unless otherwise indicated, the components of the lower applicator 30 are in all material respects the same as the components of the upper applicator 28, with such modifications as may be desirable to meet the specific performance requirements or obtain performance advantages for the lower applicator 30. For example, in some systems, the lubricant applicators may be located at different circumferential positions, on different sides of the upper and lower rollers 14 and 16, and may dispense different lubrication compositions at differing rates, i.e., each applicator may apply at different lubricant coating or composition.

The upper applicator 28 is illustrated in FIGS. 3–7 and includes a front plate 38 that is removably mounted to a rear plate 42 with mounting bolts 46. As previously mentioned, a structural core element 44 is mounted between the front plate 38 and rear plate 42. The front plate 38 preferably is provided with mounting holes 82 to accept the mounting bolts 46, which in turn correspond to mounting bolt bores 84 in the core element 44 that are sized and positioned to accept the bolts 46. When installed, the mounting bolts 46 extend through the front plate mounting holes 82, the core element bores 84 to engage threaded mounting bolt openings 86 in the rear plate 42, which allows the bolts 16 to removably fix the front panel 38 to the rear plate 42.

The core element 44 preferably is made of aluminum, polymeric, composite or other comparable materials that will provide suitable strength and rigidity to maintain the structural integrity of the applicators 28 and 30, while limiting the weight and expense of the applicator 28. Other materials may include stainless steel, steel plate and other such structural materials where the weight and cost of the applicators 28 and 30 are appropriate for the specific system, and where benefits from such alternative materials may be obtained.

The core element 44 shown in FIGS. 3–7 preferably is machined, formed or molded with cutouts 88 to further reduce weight and material cost, while providing sufficient structural strength and rigidity to the lubricant applicator 28. The shape of the cutouts 88 is a function of the materials used to form the core element 44 and the strength characteristics of the core materials, as well as the desired functions of the cutouts 88. Depending on the particular application, a variety of cutout sizes and shapes may be used, such as the rectangular shape shown in the figures, hexagonal, circular or arcuate shapes, various polygonal shapes, non-uniform shapes and other similar configurations.

Figure 8:
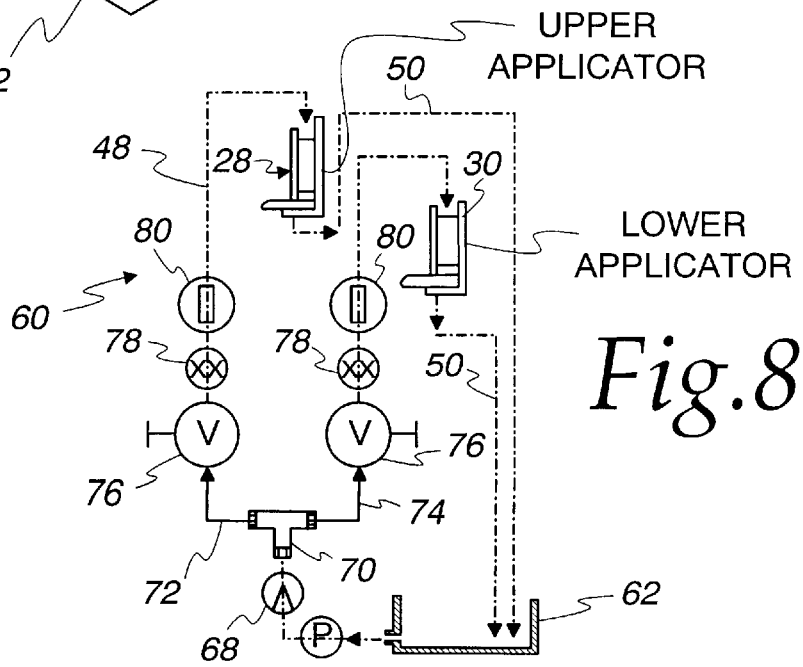
FIG. 8 is a schematic view of the control system of the preferred embodiment of the invention shown in FIG. 1.

As shown in FIG. 8, the preferred embodiment includes a lubricant delivery system 60 for providing liquid lubricant from a sump 62 (or other lubricant sources) to the applicators 28 and 30. The lubricant delivery system 60 includes a lubricant source 62, which preferably is a sump or storage vessel with sufficient supply of lubricant for the operation of the coating station 10. The lubricant source 62 may include a centralized storage system for supplying lubricant to multiple coating stations 10, or it may be a localized supply for a single coating station 10 used for a single coil or roll of metallic sheet material. The lubricant source 62 also may include replaceable storage and supply containers such as lubricant drums or cans.

In the preferred embodiment, a lubricant pump 64 draws liquid lubricant from the lubricant source 62 and directs a stream of liquid lubricant through the supply line 66 and the check valve 68, to a flow distributor 70, such as a T-connector. The lubricant stream provided by the pump 64 preferably is variable to permit the system operator to adjust the flow rate and amount of the liquid lubricant supplied to the applicators 28 and 30. At the flow distributor 70, the lubricant supply stream is separated in two or more streams, at least one for each lubricant applicator, and is directed by the supply lines 72 and 74 to the applicators 28 and 30.

The number of supply lines, the connectors and the flow distributors used in the system, as well as the arrangement of those components will depend on the specific design and intended use of the system. In some instances, it may be desirable to use additional lubricant supply lines and additional supply pumps, for example, in systems with multiple applicators applying different lubrication compositions. Similarly, the connectors and flow distributors used in the system may provide for a single supply stream or for multiple streams to supply a consistent flow of lubricant to multiple applicator systems.

The supply lines 72 and 74 include flow controls 76 which predetermine the flow rate and volumes of lubricant supplied to the applicators 28 and 30. In the preferred embodiment, the flow controls 76 employ simple hand operated needle valves for simplicity and low cost. In other systems alternative valving systems may be used, such as electronic valves (for example, solenoid controlled valving), computer operated or assisted valves, hydraulic, pneumatic valves or other such valves.

As shown in FIG. 8, in one embodiment, a second set of check valves 80 is located between the flow controls 76 and the applicators 28 and 30. In that embodiment, the supply lines 72 and 74 further are provided with flow monitors 80, which may be as simple as a view port to allow the operation to confirm the flow of lubricant through the system. The lubricant delivery system may include analog, electronic or computer controlled sensors, flow meters and directional controls for monitoring and adjusting the lubricant streams to provide further flexibility and efficiencies in specific systems.

As described above, the lubricant delivery system 60 provides liquid lubricant through conduits 48 to a reservoir 48*a* for distribution to the wick 34 via a gravity flow. The lubricant reservoir 48*a* provides and distributes a supply of liquid lubricant to the wick 34 sufficient to form a consistent, substantially uniform liquid lubricant coating or film on the lubricant receiving surfaces, such as the roller surfaces 14*a* and 16*a*, by capillary flow through the flow element matrix or wick 34.

The lubricant reservoir 48*a* may be made of a variety of materials compatible with the lubricant or lubricant composition used in the system. In one embodiment, the lubricant reservoir 48*a* is made of a non-reactive polymeric tubing with a diameter of 0.50 inches (12.7 mm) compatible with a "neat" lubrication composition used in forming "cups" from aluminum sheet material as mentioned above. In another embodiment, the reservoir 48*a* is made of aluminum.

In the embodiment as shown in FIGS. 3, 6 and 7, the lubricant reservoir 48*a* extends approximately the length of the applicator 28, entering from one side wall 40*a* and extending to a position proximate a second side wall 40*b*. In other embodiments, the reservoir 48*a* may extend into the applicator 28 from other locations, including from a position above the applicator 28, through the rear plate 46, and through multiple parts into the applicator 28 (not shown). The reservoir 48*a* may extend in whole or in multiple parts along a sufficient length of the applicator 28 to provide the proper supply and distribution of the liquid lubricant to the wick 34. Other shapes and arrangement of the reservoir 48*a* consistent with its function also may be used.

As shown in FIGS. 4, 6 and 7, the reservoir 48*a* includes a series of lubricant dispensing openings or ports 90 sized to provide a controlled flow of lubricant from the reservoir 48*a* to the wick 32 at the desired flow rate. The number and size of the lubricant dispensing openings or ports 90 is determined by the lubricant composition's viscosity, the desired flow rate to the wick 32 and other physical properties affecting the lubricant's flow properties. The dispensing ports 90 are spaced along the length of the reservoir 48*a* to provide a lubricant flow from the reservoir 48*a* that is substantially evenly distributed along the wick 32. In one embodiment, the reservoir 48*a* is provided with eight lubricant dispensing ports 90, each about 0.004 inches (0.1 mm) in diameter, and additional or fewer openings may be used where appropriate. The liquid lubricant flow rates, amount, and distribution from the reservoir 48*a* to the wick 32 also may be adjusted by modifying the number, diameter and spacing of the dispensing ports 90.

In one embodiment, "neat" lubricant used to lubricate sheet aluminum stock before the "cupping" operation is supplied from the reservoir 48*a* to the wick material 34 at an average rate of about 0.006 ml to about 2.4 ml per square foot of sheeting material. In another aspect, the lubricant is supplied at a rate of about 0.30 to 2.0 ml per running foot of aluminum stock that is about 60 inches (152 cm) wide. In yet another aspect, the lubricant is supplied at a rate of about 1.0 ml per running foot of sheet about 60 inches (152 cm) wide, which typically is equivalent to about 0.10 gm of lubricant per square foot of aluminum stock or about 35 mg of lubricant per typical "cup" (where approximately 4 to 5 cups are made per square foot of sheet stock).

In addition, in some embodiments, it may be desirable to provide dispensing ports 90 with variable sizes and flow rates, and with optional mechanical or electronically operated closures for modification of the number, spacing, and operation of the dispensing apertures 90 to selectively control the flow rate, amount and distribution pattern of the liquid lubricant. Such variable control of the lubricant flow may be desirable, for example, in manufacturing systems that form products of different sizes from metallic sheet materials with variable properties, thicknesses and sheet width.

As shown in FIG. 4, as well as in FIGS. 3, 6 and 7, the lubricant dispensing ports 90 preferably are circumferentially positionable relative to the horizontal axis x and vertical axis y of the reservoir 48*a* . The circumferential positioning of the dispensing ports 90 relative to the x and y axis permits the maintenance of a preselected level of lubricant in the reservoir 48*a* . The liquid lubricant level with the reservoir 48*a* may be maximized by positioning the dispensing ports 90 along the y axis of the reservoir 48*a* , at the top of the reservoir 48*a* , and may be minimized by positioning the ports 90 along the y axis at the bottom of the reservoir 48*a*.

By adjusting the lubricant flow in the supply line 16, the level of liquid lubricant within the reservoir 48*a* also may be adjusted from below the lower margin of the dispensing ports 90 to a level above those port lower margins so that the lubricant is free to flow to the wick 32, and may be returned to a level below the port lower margins to limit and halt the flow of lubricant to the wick 32. The maintenance of the liquid lubricant at a such preselected levels within the reservoir 48*a* assists in maintaining a controlled, consistent lubricant distribution and flow from the reservoir 48*a* through the dispensing ports 90 based on the viscosity and flow properties of the lubricant, as well as the ports 90 size number and spacing.

The volume of lubricant within the reservoir 48 at those preselected levels also may be used to mitigate the effect of minor fluctuations in the lubricant supply flow to avoid substantial interruptions and to avoid surges in the lubricant flow from the dispensing ports 90. These advantages are of particular significant in efforts to minimize the amount of lubricants applied to the metallic sheet surfaces, or to otherwise apply relatively small amounts of lubricants to those surfaces. The variable positioning of the ports 90 also allows for further adjustments to the lubricant flow as may be necessary in such demanding applications.

In addition, the maintenance of predetermined level of liquid lubricant within the reservoir 48*a* permits the rapid start up of the lubricant flow to the wick 32 without time consuming delays to refill, prime or significantly increase the supply of lubricant in the reservoir 48*a* during or after temporary shut downs for maintenance, troubleshooting and other similar reasons. This feature also permits the rapid reduction of the lubricant flow from the lubricant supply to the reservoir 48*a* to minimize the collection of lubricant on sheet surfaces or roller surfaces during short term interruptions of the forming system, or while the system is slowed or idled.

In the preferred embodiment, as shown in FIGS. 4 and 7, the dispensing ports 90 further are canted towards the inner surface 42*a* of the rear plate so that as lubricant flows through the dispensing ports 90, the lubricant flows on to and across the rear plate inner surface 42*a* to the wick 32. In doing so, the lubricant flow tends to spread to reduce possible dry or under-supplied segments of the wick 32 and to encourage the even distribution of lubricant throughout the flow element matrix or wick 32. In certain embodiments, the rear plate inner surface 42*a* may be textured, machined or formed to further direct the lubricant flow to the matrix or wick 32 to enhance the distribution of the lubricant composition.

As also shown in FIGS. 5–7, in the preferred embodiment, the core element cut outs 88 form conduits providing access and direction for the flow of lubricant to the wick 32. In alternative embodiments, in the core element 44 or similar structure may form conduits of a variety of suitable sizes, shapes and numbers to direct the lubricant flow from the reservoir 48*a* to the wick 32. In addition, the surfaces of the cutouts 88 forming the conduits may also contact and direct lubricant flow through the conduits.

As shown in FIGS. 2–7, the wick 32 in that embodiment is positioned and supported by a lower shelf 42*b* of the rear plate 42, below the core element 44 and in flow communication with lubricant reservoir 48*a* . As shown in FIGS. 3–6, the wick 32 is secured against the lower shelf 42*b* by the lower margin of the front plate 38, which is positioned relative to the lower shelf 42*b* to contact and exert clamping pressure against the wick 32. The wick 32 also may be located in other positions relative to the lubricant reservoir 48*a* and may be secured by other components or combinations of components.

In one embodiment, the wick 32, in addition, preferably is positioned relative to the lubricant reservoir 48*a* to receive a supply of liquid lubricant from the reservoir 48*a* along the length of the matrix 32 as a result of the gravity flow of the liquid lubricant from reservoir 48*a* . In that embodiment, it typically is not necessary to provide assistance from pumps, piston drives or other pressurized flows from the reservoir 48*a* which tends to reduce undesirable variations in the lubricant supply to the wick 32, particularly when there are variations in the sheet feed rates, or the sheet is moving at relatively high feed rates. That flow also reduces substantial localized excesses or inadequacies in the amount of lubricant supplied to the wick 32.

As shown in FIG. 2, in that embodiment, the portion of the wick 32 disposed to engage a lubricant receiving surface, such as the roller surface 14*a*, is shaped to provide a flexible, marginal edge 32*a* that may be biased against that receiving surface to provide positive, consistent contact with the lubricant receiving surface. That marginal edge 32*a* is preferably beveled to provide a flexible portion that is easier to maintain in the desired positive engagement with the surface 14*a* and other suitable outer edge shapes also may be used. The size, angle and approximate bending range of the beveled portion of marginal edge 32*a* is selected based on the desired surface area of the marginal edge 32*a* to be kept in contact with the receiving surface which will affect the amount and rate of the lubricant flow from the wick 32 to receiving surface.

The lubricant applicator 28 further is provided with a lubricant return system to permit the continuous feed of lubricant to the wick 32 by collecting excess lubricant from the wick 32 and directing that excess lubricant back to the sump 62 for reuse, or to a suitable collection container. In the preferred embodiment, this system is provided by a lubricant return channel 52 in the shelf 42*b* formed in the rear plate 42. The return channel 52 is shaped and positioned so that it collects excess lubricant from the wick 32 that flows or seeps into the channel 52 as a result of the gravity feed of lubricant into and percolation or flow through the wick 32. The return channel 52 further directs the excess lubricant to the lubricant return line 50 which is routed to the lubricant sump for continuous reuse of the liquid lubricant, or to another holding vessel for further treatment, reuse, recycling or other such purposes.

The lubricant return system, alternatively, may employ other lubricant collection and return arrangements modified for specific application systems, flow element matrices or wicks and lubricants. For example, collections surfaces, channels and conduits of a variety of configurations may be positioned to redirect excess lubricant from the wicks to suitable locations for holding, storing, reusing or redirecting excess lubricant.

As shown in FIGS. 1 and 2, when the applicators 28 and 30 are installed, the upper applicators 28 and 30 are positioned to flexibly bias the exposed edges 32*a* and 34*a* of the wicks 32 and 34, respectively, into engagement with the rollers surfaces 14*a* and 16*a*. The applicators 28 and 30, preferably are positioned so that the rotation of the rollers 14 and 16 urges the exposed wick 32*a* and 34*a* into positive engagement with the surfaces of the rollers 14 and 16.

As the rollers 14 and 16 are rotated, the exposed edges 32*a* and 34*a* flow lubricant onto the surfaces of the rollers 14 and 16 to form a lubricant coating on the roller surfaces 14*a* and 16*a*. The liquid lubricant is supplied at a rate effective to provide sufficient lubricant to coat the surfaces 12*a* and 12*b* of the metallic sheet material with the predetermined amount of the liquid lubricant composition. As previously mentioned, the rollers 14 and 16 similarly are positioned to provide sufficient nip or pinch pressure to positively engage the metallic sheet material surfaces 12*a* and 12*b* , and to flow the lubricant onto the exposed surfaces 12*a* and 12*b* to provide a significantly uniform and evenly distributed coating or film of the lubricant composition on the sheet surfaces 12*a* or 12*b* both, effective for the purposes of forming the metallic sheet material 12 into a useful article.

Using the apparatus generally described above (with minor, if any, material changes), a "neat" aluminum "cupping" lubricant composition, such as that also mentioned above, was applied to form lubricant coatings on the upper and lower surfaces of aluminum sheet stock used to make can bodies with aluminum sheet stock about 60 inches (152 cm) wide and about 0.0108 inches (0.274 mm) thick. The sheet stock feed rates, when the sheet was moving, varied from about 5 inches (12.7 cm) per minute to about 90 feet (27.4 m) per minute. The wicks had a thickness of about 0.375 inches (9.5 mm) and a weight of 35 oz/yd$^2$ for use with lubricants with viscosities of about 110 and 162 SSU @ 100° F. (37.8° C.). Acceptable lubricant coatings were produced at weights as low as 130–140 mg/ft$^2$, which was equivalent to about 20 to about 30 mg per "cup". The press speeds averaged about 180 "cupping" press strokes per minute, and increased to as fast as about 200 to about 225 press strokes per minute, to produce an average of approximately 3000 "cups" per minute. In another embodiment, similarly acceptable results were achieved using wicks with a thickness of 0.75 inches (19 mm) and a weight of 112 oz/yd$^2$, using lubricants with viscosities of about 110 and 162 SSU @ 100° F. (37.8° C.).

In an alternative embodiment, the applicators 28 and 30 also may be positioned to bias the exposed matrix edges 32*a* and 34*a* directly into engagement with the upper 12*a* and lower surfaces 12*b* of the sheet material 12. In that embodiment, the lubricant flows directly onto the sheet surfaces, and at a rate effective to form the desired lubricant coatings discussed above. Similarly, as previously mentioned, the applicators 28 and 30 also may be positioned to apply lubricant to the surfaces of the rollers in a multi-roller transfer system. In such a system, the lubricant flow rates and wick densities must be adjusted to account for the use of multiple transfer rollers.

Consequently, the invention provides a reliable, cost effective and efficient system for the application of lubricants to metallic sheet surfaces. The invention, in addition, provides the advantages of such a system without the use of complicated reciprocating pistons, precision pumps or other such complex pumping technology.

While the invention has been described by reference to certain specific descriptive and examples which illustrate preferred materials and conditions, it is understood that the invention is not limited thereto. Rather all alternatives, modifications and equivalents within the scope of the invention so described and considered to be within the scope of the appended claims.

What is claimed is:

1. An apparatus for applying a liquid lubricant to at least two surfaces of a continuously moving, generally planar metal sheet, the apparatus comprising:

at least two wicks;

at least one reservoir for the wicks; and at least one conduit disposed above the wicks, the conduit effective for supplying the liquid lubricant from the reservoir to the wicks by downward, gravity flow, each wick disposed about one of the moving surfaces and moving the liquid lubricant downwardly through the wicks to the metal sheet surfaces by downward, capillary flow of the lubricant through the wicks without the application of an external mechanical force to generate a resulting pressure gradient through the wicks to move the liquid lubricant therethrough.

2. The apparatus of claim 1 wherein each wick comprises a matrix of fibrous elements, the lubricant having a viscosity of from about 40 to about 800 SSU at about 100° F., each wick having a density which is effective for providing a lubricant coating of at least about 130 mg/$M^2$ on one of the surfaces of the metal sheet moving from at least about 5 inches per minute to about 90 feet per minute.

3. The apparatus of claim 2 wherein each wick has a density of from about 0.072 oz to about 0.175 oz per cubic inch.

4. The apparatus of claim 3 wherein each wick has a thickness of about 0.25 inches to about 0.75 inches.

5. The apparatus of claim 2 wherein each wick has a weight of from about 35 ounces to about 85 ounces per square yard at a thickness of about 0.375 inches.

6. The apparatus of claim 2 wherein each wick has a weight at least about 112 ounces per square yard at a thickness of about 0.75 inches.

7. The apparatus of claim 2 wherein the reservoir is located relative to the wicks effective for supplying lubricant to the wick by gravity flow.

8. The apparatus of claim 1 wherein the reservoir is formed of at least one wall containing the liquid lubricant, the reservoir located relative to the wicks effective for supplying lubricant to the wicks by gravity flow, and the reservoir wall provided with a plurality of openings therethrough sized to supply lubricant from the reservoir to the wicks at a rate of about 0.006 ml to about 2.4 ml per square foot of metal sheet.

9. The apparatus of claim 1 wherein the reservoir is formed of at least one wall having openings therethrough, and the openings sized to supply lubricant from the reservoir to the wick at a rate of about 0.30 ml to 2.0 ml per running foot of sheet material having a width of about 60 inches.

10. The apparatus of claim 1 wherein each wick is adjacent to and in contact with the moving metal sheet for application of the lubricant.

11. An apparatus for applying a liquid lubricant to at least one surface of a continuously moving metal sheet, the apparatus comprising:

at least one wick;

at least one reservoir;

at least one conduit effective for supplying the liquid lubricant from the reservoir to the wick, the wick supplying liquid lubricant to the metal sheet by capillary flow of the lubricant through the wick without the application of an external mechanical force to generate a resulting pressure gradient through the wick to move the liquid lubricant therethrough; and at least one application/transfer roller which is in rolling contact with the wick, the application/transfer roller in combination with the wick being effective for moving the liquid lubricant from the wick to the metal sheet.

12. The apparatus of claim 11 wherein the application/transfer roller is in rolling contact with the metal sheet.

13. The apparatus to claim 12 wherein the wick comprises matrix of fibrous elements with a density of between about 0.072 ounces to about 0.175 ounces per cubic inch and a thickness selected to provide a supply of a "neat" lubricant with a viscosity of from about 40 to about 800 SSU at 100° F. to the application/transfer roller in amounts sufficient to form a lubricant coating on the metal sheet of at least about 130 mg/$M^2$.

14. The apparatus of claim 13 wherein the wick is selected to provide the lubricant coating on the surface of the metal sheet moving at a rate varying from about 5 inches per minute to about 90 feet per minute.

15. The apparatus of claim 13 wherein the wick thickness is from about 0.25 inches to about 0.75 inches and the density of the wick is selected to form the lubricant coating on the metal sheet using a "neat" lubricant comprising at least about 50% by weight of a combination of petroleum oils and vegetable oils.

16. An apparatus for applying a liquid lubricant to at least one surface of a continuously moving metal sheet, the apparatus comprising:

at least one wick;

a reservoir of liquid lubricant located relative to the wick effective to supply lubricant to the wick by gravity flow;

a plurality of conduits between the reservoir and the wick, the conduits disposed to direct the liquid lubricant flow from the reservoir to the wick, the conduits including at least one surface positioned to receive the lubricant flow thereon and to spread the lubricant flow relative to the wick; and at least one application/transfer roller which is in rolling contact with the wick, the application/transfer roller in combination with the wick being effective for moving the liquid lubricant from the wick to the metal sheet, the wick supplying liquid lubricant to the metal sheet by capillary flow of the lubricant through the wick without the application of an external mechanical force to generate a resulting pressure gradient through the wick to move the liquid lubricant therethrough.

17. The apparatus of claim 16 wherein the wick comprises a matrix of fibrous elements, the lubricant having a viscosity of from about 40 to about 800 SSU at about 100° F., the wick having a density which is effective for providing a lubricant coating of at least about 130 mg/$M^2$ on the surface of the metal sheet moving from at least about 5 inches per minute to about 90 feet per minute.

18. The apparatus of claim 16 wherein the wick has a density of from about 35 oz/square yard to about 112 oz/square yard at a thickness of from about 0.250 inch to about 0.750 inches.

19. A method for applying a lubricant to a moving metal sheet, the method comprising:

supplying by gravity flow a liquid lubricant from a reservoir through a plurality of tubes to a wick;

moving the liquid lubricant through the wick by capillary flow; and applying the lubricant to at least one application/transfer roller which is in rolling contact with the wick, the transfer roller in combination with the wick being effective for moving the liquid lubricant from the wick to the metal sheet, the wick supplying liquid lubricant to the application/transfer roller by capillary flow of the lubricant through the wick without the application of an external mechanical force to generate a resulting pressure gradient through the wick to move the liquid lubricant therethrough to the application/transfer roller.

20. An apparatus for applying a liquid lubricant to at least one surface of a continuously moving metal sheet, the apparatus comprising:

at least one wick;

at least one reservoir; and at least one conduit effective for supplying the liquid lubricant from the reservoir to the wick by downward gravity flow, and one or more dispersal surfaces disposed between the conduit and the wick effective to spread the lubricant generally to portions of the wick supplied by the conduit; and the wick supplying liquid lubricant to the metal sheet by capillary flow of the lubricant through the wick without the application of an external mechanical force to generate a resulting pressure gradient through the wick to move the liquid lubricant therethrough the wick to move the liquid lubricant therethrough.

21. The apparatus of claim 20 whereby the conduit is disposed above the wick and the moving metal surface, and the one or more dispersal surfaces are effective to spread the lubricant generally uniformly to the portions of the wick supplied by the conduit, and the wick is effective for supplying the liquid lubricant to the moving metal surface by downward capillary flow without the application of significant external heating of the lubricant.

22. The apparatus to claim 21 wherein the wick comprises matrix of fibrous elements with a density of between about 0.072 ounces to about 0.175 ounces per cubic inch and a thickness selected to provide a supply of undiluted lubricant with a viscosity of from about 40 to about 800 SSU at about 100° F. in amounts sufficient to form a lubricant coating on the metal sheet of at least about 130 mg/$M^2$.

23. An apparatus for applying a liquid lubricant to at least two surfaces of a continuously moving, generally planar metal sheet moving in a generally linear direction and effective for applying liquid lubricant to the surfaces of the metal sheet traveling at variable rates relative to the apparatus, the apparatus comprising:

at least two wicks;

at least one reservoir; and at least one conduit effective for supplying the liquid lubricant from the reservoir to the wicks by downward gravity flow from a location above the wicks and the moving metal surfaces; the wicks supplying liquid lubricant to the moving metal surfaces by capillary flow of the lubricant through the wicks without the application of an external mechanical force to generate a resulting pressure gradient through the wicks to move the liquid lubricant therethrough; a supply of liquid lubricant from the conduit and the thickness and density of the wicks effective to provide a generally uniform coating of liquid lubricant to the metal sheet surfaces at the variable traveling rates of the metal sheet.

* * * * *

UNITED STATES PATENT AND TRADEMARK OFFICE

CERTIFICATE OF CORRECTION

PATENT NO. : 6,372,043 B2
DATED : April 16, 2002
INVENTOR(S) : Tracy et al.

It is certified that error appears in the above-identified patent and that said Letters Patent is hereby corrected as shown below:

Column 20,
Line 20, delete the words “two surfaces” and insert the words -- one surface --.

Signed and Sealed this

Third Day of December, 2002

JAMES E. ROGAN
*Director of the United States Patent and Trademark Office*